United States Patent [19]

Muntz et al.

[11] Patent Number: 4,933,546

[45] Date of Patent: Jun. 12, 1990

[54] ORIFICE RING ION BEAM NEUTRALIZER

[75] Inventors: Eric P. Muntz, Pasadena, Calif.; John W. Brook, Northport; Vincent S. Calia, Greenlawn, both of N.Y.

[73] Assignee: Grumman Aerospace Corporation, Bethpage, N.Y.

[21] Appl. No.: 235,074

[22] Filed: Aug. 23, 1988

[51] Int. Cl.[5] ..... H05H 3/00

[52] U.S. Cl. ..... 250/251

[58] Field of Search ..... 250/251, 423

[56] References Cited

U.S. PATENT DOCUMENTS

| | | | |
|---|---|---|---|
| 2,540,256 | 2/1951 | Gretener . | |
| 2,680,345 | 6/1954 | Frost . | |
| 2,901,628 | 8/1959 | Lamb . | |
| 3,007,072 | 10/1961 | McGinn et al. . | |
| 3,363,124 | 1/1968 | Bensussan et al. . | |
| 3,405,305 | 10/1968 | Winzeler et al. . | |
| 3,657,542 | 4/1972 | Futch, Jr. et al. . | |
| 3,742,219 | 6/1973 | Damm et al. . | |
| 3,846,636 | 11/1974 | Zehr et al. . | |
| 4,092,534 | 5/1978 | Anderson . | |
| 4,140,576 | 2/1979 | Fink et al. . | |
| 4,140,577 | 2/1979 | Fink et al. . | |
| 4,361,762 | 11/1982 | Douglas . | |
| 4,447,732 | 5/1984 | Leung et al. | 250/427 |
| 4,463,255 | 7/1984 | Robertson et al. . | |
| 4,682,564 | 7/1987 | Cann | 118/620 |

*Primary Examiner*—Bruce C. Anderson

*Attorney, Agent, or Firm*—Pollock, Vande Sande & Priddy

[57] ABSTRACT

A beam of negatively charged ions is neutralized by impinging jets which dislodge elctrode electrons from the ions. Gas jets are created by orifices circumferentially located around a ring. The symmetrical radial distribution of the orifices does not create a net radial thrust on the ring, which is an important consideration in low-gravity outer space. Further, maximized gas dynamics creates a neutralized beam with a uniform gas density at the exit thereof and an optimized neutralized ion fraction, as compared with the population of ions in the introduced beam.

13 Claims, 2 Drawing Sheets

ORIFICE RING ION BEAM NEUTRALIZER

FIELD OF THE INVENTION

The present invention relates to ion beam neutralizers, and more particularly to such a neutralizer configured as a ring having peripherally installed orifices.

BACKGROUND OF THE INVENTION

In a number of applications utilizing negative ion beams, it is necessary or desirable at some point of the beam's travel to neutralize the negative ions. In the past gas dynamics have been employed to physically dislodge excess electrons from negatively charged ions in a beam. Such dislodgement is generally accomplished in a tube where gas molecules are injected into a beam of negative ions; and as a result of the gas density distribution brought about by gas dynamics, the electron dislodgement of ions in the beam occurs thereby neutralizing the beam.

Utilization of neutralizers such as tubes often presents a space requirement which is impractical or disadvantageous, such as in spacecraft.

Further, prior art approaches accomplish neutralization of ions in the beam but do not accomplish this on a uniform basis at an exit port of the neutralizer. This non-uniform distribution of prior art neutralizers results in a loss of efficiency in converting from an ion to a neutral beam.

A further disadvantage of prior art neutralizers is the maintenance of a gas dynamics condition for an excessive distance wherein neutralized ions in the beam are further subjected to electron dislodgement which converts the neutralized ions to positive ions, thereby defeating the purpose of the neutralizer.

BRIEF DESCRIPTION OF THE PRESENT INVENTION

The present invention incorporates a ring neutralizer which encircles an ion beam, the ring having orifices circumferentially situated so as to inject pulsed jets of gas into the ion beam to accomplish electron dislodgement of ions so that a neutralized beam emerges.

As compared with prior art approaches, the present invention does not require a tube container for containing the beam and neutralizer thereby alleviating space and structure limitations. Further, the present invention produces a neutralized beam with a uniform gas column density which encourages a uniform neutralized ion population at the exit of the neutralizer.

The invention envisions the utilization of pulsed injection jets of gas molecules, in addition to steady flow, thereby offering greater flexibility in design considerations of the neutralizer. Pulsed injection may be preferred because it leads to more uniform neutralizer condition across the neutralizer.

The utilization of a ring structure with circumferentially oriented orifices eliminates radial thrust from the injected gas, which is an important consideration when used in an outer space environment.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
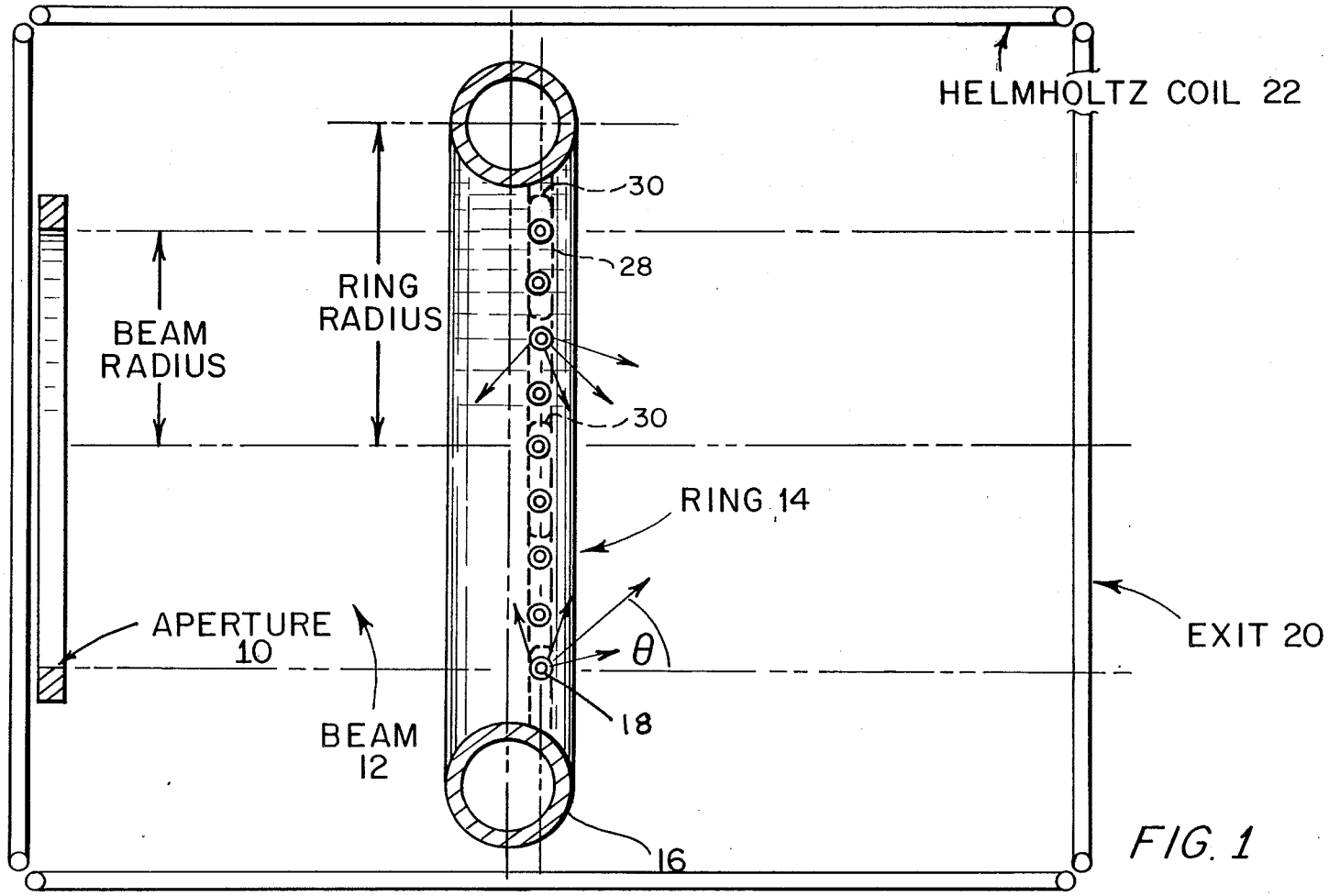
FIG. 1 is a schematic representation of the present neutralizer.

Referring to FIG. 1, aperture 10 defines the entry area for a beam 12 of negatively charged ions. As indicated in the figure, the beam travels from left to right. At an intermediate point along the beam and coaxial therewith is a hollowed loop, which is the heart of the present ion neutralizer. In a preferred embodiment of the invention, the loop is a ring 14 which is a hollowed toroid demonstrated by circular cross section 16. However, other hollowed closed loop shapes may be used.

Along the circumference of ring 14 is a plurality of regularly spaced orifices 18 whose central axes form an angle, theta, not necessarily 90°, with respect to the axis. Each of the orifices is similarly angularly positioned with respect to the axis of the ring 14. The orifices provide exit points for molecules of a gas pumped through the ring to create gas dynamically a density distribution which will intersect with the ions of the beam thereby resulting in the dislodgement of electrons from individual ions which neutralizes the ions of the beam.

The angle theta is adjusted to provide optimum results from the gas dynamics. Specifically, the angle is chosen to provide a maximum uniform density neutralized beam after the gas molecules have mixed with the beam ions. The point at which exit 20 exists is chosen so that the fraction of neutralized ions existing at the exit is a maximum. It is to be noted that, after an ion has been neutralized, a collision of a neutralized ion with a gas molecule introduced by ring 14 may result in the further dislodgement of an electron which results in the creation of a positive ion. This would defeat the objective of the invention, namely the creation of neutralized ions. Accordingly, the gas dynamics condition, angles, etc., must be chosen so that the fraction of the neutralized ions is optimized.

If the present invention is employed in an outer space application, the beam passing from exit 20 will be subjected to the Earth's magnetic field while it is being neutralized and this will cause deviation from the axial direction of the beam. In order to minimize such an effect, a suitable Helmholtz coil arrangement 22, extending substantially over the effective length of the gas flow, may be employed along the beam to cancel the component of the earth's magnetic field perpendicular to the beam axis.

The present invention has been described in terms of a plurality of orifices located within ring 14. An alternate construction is the use of a continuous slot 28 or a series of slots 30 formed in the ring. Further, although the present invention may be employed with a steady gas flow from neutralizer ring 14, it is anticipated that the introduction of pulsed jets from the neutralizer ring will provide more effective distribution of gas density per unit of gas mass flow. A more effective distribution of gas density will result in a more efficient distribution of gas density within the ion beam which will produce a more uniform distribution of the maximized fraction of neutral ions.

Figure 2:
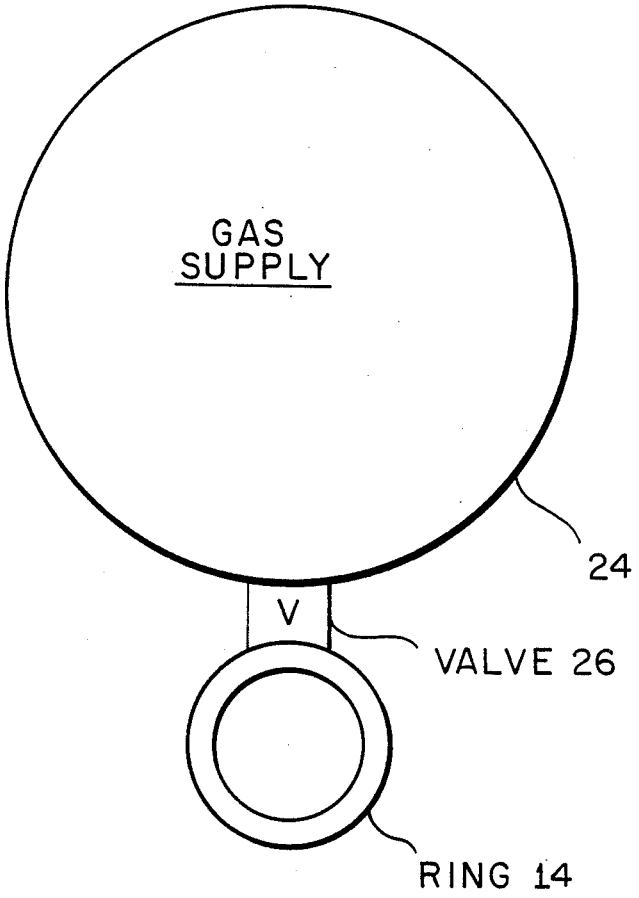
FIG. 2 is a schematic illustration of a gas reservoir system for producing pulse gas jets.

In order to produce pulsed jets, a gas delivery system as simplified in FIG. 2 may be employed. A large gas supply reservoir 24 contains the gas which is to be introduced through the neutralizer ring 14. Reservoir 24 communicates with the interior volume of ring 14, which is kept as small as practicable, by means of a single or multiple conventional high frequency valve(s) 26. The existence of a large reservoir 24, a high frequency valve or valves 26, and a small interior volume of the ring 14 permits the small interior volume of ring 14 to fill quickly and empty quickly. Consequently, gas jets delivered from orifices 18 exhibit strong pulsed bursts of gas which advantageously dislodges electrons from ions in the beam.

As a result of the invention as described, the exit delivers a neutralized ion beam with the maximum fraction of neutralized ions possible. Further, the density of neutralized ions at the exit 20 is substantially uniform.

The symmetrical radial distribution of orifices 18 creates no resultant unwanted radial thrust on the ring 14, which is an important consideration when such a ring is utilized in outer space. The only thrust which is created from the gas jets delivered by orifices 18 is a net axial thrust of minimal effect.

It should be understood that the invention is not limited to the exact details of construction shown and described herein, for obvious modifications will occur to persons skilled in the art.

We claim:

1. A containerless apparatus for neutralizing negative ions and comprising:

an ion supply aperture for emitting an ion beam along an axis;

a hollowed loop located coaxially around the beam;

at least one opening formed in the loop and symmetrically directing jets of gas from the loop interior into the ion beam thereby dislodging electrons from ions in the beam which results in their neutralization;

an exit defined along the beam after neutralization for delivering a maximized fraction of neutralized ions thereat, the beam at the exit exhibiting a substantially uniform density.

2. The structure set forth in claim 1 wherein a plurality of openings are employed and are individual orifices symmetrically located along the periphery of the loop.

3. The structure set forth in claim 1 wherein the opening is in the form of a continuous slot symmetrically located along the periphery of the loop.

4. The structure set forth in claim 1 wherein a plurality of openings are employed and are in the form of a series of slots symmetrically located along the periphery of the loop.

5. The structure set forth in claim 1 together with a coil coaxially mounted in the vicinity of the beam exit for minimizing deflection of the beam in the presence of an external magnetic field.

6. The structure set forth in claim 1 together with means for supplying the hollowed loop with a pulsed gas flow resulting in pulsed gas jets being introduced into the ion beam for increasing the efficiency of the electron dislodgement effect of introduced gas molecules.

7. The structure set forth in claim 2 wherein the openings are similarly formed in a radially offset manner so that the jets are not directed perpendicularly toward the beam, the offset being adjusted to maximize uniform density of the delivered neutralized ions.

8. A negative ion beam neutralizer comprising:

an aperture for supplying a beam of negative ions;

a hollowed loop positioned coaxially around the beam;

a plurality of orifices formed in the loop and symmetrically directing jets of gas from the loop interior into the ion beam thereby dislodging electrons from ions in the beam which results in ion neutralization;

an exit defined along the beam after neutralization for delivering a maximized fraction of neutralized beam ions thereat, the beam at the exit exhibiting a substantially uniform density; and means for supplying the hollowed loop with a pulsed gas flow resulting in pulsed gas jets being introduced into the ion beam for increasing the electron dislodgement effect of introduced gas molecules.

9. The structure set forth in claim 8 together with a coil coaxially mounted in the vicinity of the beam exit for minimizing deflection of the beam in the presence of an external magnetic field.

10. The subject matter set forth in claim 9 wherein the openings are similarly formed in a radially offset manner so that the jets are not directed perpendicularly toward the beam, the offset being adjusted to maximize uniform density of the delivered neutralized ions.

11. A method for neutralizing negative ions comprising the steps:

forming a beam of ions to flow in an axial direction;

introducing a plurality of gas jets symmetrically and coaxially into the beam thereby dislodging electrons from ions in the beam, which results in their neutralization, the jets being directed toward the beam axis in a non-radial direction relative to the beam axis, for maximizing the uniform density of the neutralized ions; and providing an exit for the neutralized ions at a point where the fraction of neutralized ions in the beam is maximized.

12. The method set forth in claim 11 wherein the jets are gas pulses.

13. The method set forth in claim 12 together with subjecting the exit to a magnetic field symmetrical with the beam axis for minimizing beam deflection at the exit due to a external magnetic field.

* * * * *

UNITED STATES PATENT AND TRADEMARK OFFICE

CERTIFICATE OF CORRECTION

PATENT NO. : 4,933,546

DATED : June 12, 1990

INVENTOR(S) : Eric P. Muntz, et al.

It is certified that error appears in the above-identified patent and that said Letters Patent is hereby corrected as shown below:

In the title page, in the Abstract, line 2, delete "elctrode".

Column 4, line 55, change "a" to --an--.

Signed and Sealed this

Seventeenth Day of September, 1991

*Attest:*

HARRY F. MANBECK, JR.

*Attesting Officer*

*Commissioner of Patents and Trademarks*